US007668494B2

(12) United States Patent
Kubo et al.

(10) Patent No.: US 7,668,494 B2
(45) Date of Patent: Feb. 23, 2010

(54) FIXING APPARATUS

(75) Inventors: Takashi Kubo, Kyoto (JP); Hiroaki Hori, Kyoto (JP); Yasunori Minakuchi, Nara (JP); Yoshinobu Tateishi, Nara (JP); Yasunobu Ohkawa, Nara (JP); Yoshinobu Okumura, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 477 days.

(21) Appl. No.: 11/554,063

(22) Filed: Oct. 30, 2006

(65) Prior Publication Data

US 2007/0104503 A1 May 10, 2007

(30) Foreign Application Priority Data

Nov. 7, 2005 (JP) ..... 2005-322436

(51) Int. Cl.
*G03G 15/20* (2006.01)

(52) U.S. Cl. ..... 399/328; 399/67; 399/69

(58) Field of Classification Search ..... 399/328
See application file for complete search history.

(56) References Cited

U.S. PATENT DOCUMENTS 7,239,837 B2 7/2007 Hamada et al.
2005/0123330 A1 * 6/2005 Yoshimura et al. ..... 399/328
2005/0191063 A1 9/2005 Ichikawa et al.

FOREIGN PATENT DOCUMENTS

| | | |
|---|---|---|
| JP | 08-006426 | 1/1996 |
| JP | 2003-015459 | 1/2003 |
| JP | 2003-091124 | 3/2003 |
| JP | 2004-004234 | 1/2004 |
| JP | 2004-145165 | 5/2004 |

* cited by examiner

*Primary Examiner*—David M Gray
*Assistant Examiner*—Roy Yi
(74) *Attorney, Agent, or Firm*—Renner, Otto, Boisselle & Sklar, LLP

(57) ABSTRACT

In an embodiment of the present invention, a pressure application mechanism portion is provided with a pressure-varying link structure arranged so as to be movable in lateral directions along an upper end portion of a device frame, a drive shaft having an eccentric cam for moving the pressure-varying link structure in the lateral directions, a shaft holding structure arranged so as to be rotatable coupled to the pressure-varying link structure, and a coil spring for applying a biasing force to the shaft holding structure in one direction along the upper end portion of the device frame, and a rotational movement is carried out to make a pressure roller approach and move away from a heat roller so as to achieve a relatively low pressure during a color processing mode and a relatively high pressure during a monochrome processing mode.

6 Claims, 7 Drawing Sheets

FIXING APPARATUS

CROSS REFERENCE TO RELATED APPLICATIONS

This application claims priority under 35 U.S.C. §119(a) on Patent Application No. 2005-322436 filed in Japan on Nov. 7, 2005, the entire contents of which are hereby incorporated by reference.

BACKGROUND OF THE INVENTION

1. Field of the Invention

The present invention relates to fixing apparatuses of image forming apparatuses in which a color processing mode or a monochrome processing mode in printing process is selectable.

2. Related Art

In recent years, the print processing speeds of image forming apparatuses have been becoming faster. Furthermore, in addition to conventional monochrome printing image forming apparatuses, development of color printing image forming apparatuses has been advancing. As an example of color printing image forming apparatuses there are image forming apparatuses that use an intermediate transfer system in which a color image is formed on a sheet of paper by using a plurality of electrostatic latent image carriers with color separated image information of a plurality of colors (for example, four colors of K, C, M, and Y) and overlaying and transferring these onto an intermediate transfer belt that rotates and contacts the electrostatic latent image carriers with a predetermined pressure, after which transfer of the images as a combined whole is carried out onto a sheet (sheet of paper) that is transported from a paper feed portion (paper feed cassette for example).

In the above-described image forming apparatus, there is a gap in the number of print processing sheets between color processing mode and monochrome processing mode, and it is common for monochrome processing mode to have processing speeds generally 2 to 3 times faster compared to color processing mode.

In the fixing apparatus installed in this image forming apparatus, the power supplied to the heaters of the heat roller and the pressure roller is determined based on the total power consumption determined for the image forming apparatus.

However, in an image forming apparatus that has processing modes in which the number of sheets being passed varies, it is difficult to achieve appropriate fixing performance corresponding to each processing mode when the power consumption of the fixing apparatus is constant. That is, although it also depends on power consumption, when the power consumption is set so as to obtain an appropriate fixing performance in a slow processing mode, there is the possibility that fixing defects will be produced in the fast processing mode, and conversely, when the power consumption is set so as to obtain an appropriate fixing performance in the fast processing mode, there is the possibility that excessive fixing will occur in the slow processing mode. In attempting to deal with such fixing defects and excessive fixing without varying the power consumption, it is conceivable to change the pressing force of the heat roller and the pressure roller according to the processing mode.

In this case, a fixing apparatus described in JP H8-6426A is proposed as a mechanism for adjusting the pressing force of the heat roller and the pressure roller. With this fixing apparatus, a journal bearing is mounted on a pressure lever and the pressure roller can slide vertically inside a slit provided in a lower frame. Furthermore, the pressure lever can swing being pivotably mounted on a shaft and by applying a pressure spring on the end thereof, the pressure roller is caused to press against the fixing roller. Furthermore, two shaft bearing holes are provided for the pressure lever and by varying the bearing hole into which the shaft is inserted, a distance between the shaft (fulcrum of the pressure lever) and the point of application of the pressure spring is changed, which enables the pressing force to be varied.

With the fixing apparatus described in JP H8-6426 A, although the pressing force of the heat roller and the pressure roller can be adjusted in such ways as varying the shaft bearing holes into which the shaft is inserted and by applying an actual pressure spring, these adjustments involve merely adjusting the pressing force of the heat roller and the pressure roller to an always-constant pressure, and since the adjustments are manual adjustments, this does not involve adjusting the pressing force of the heat roller and the pressure roller according to the processing mode.

SUMMARY OF THE INVENTION

An object of the present invention is to provide in an image forming apparatus in which there is a gap in the number of print processing sheets between a color processing mode and a monochrome processing mode, and in which the monochrome processing mode has a processing speed generally 2 to 3 times faster compared to the color processing mode, a fixing apparatus capable of securing sufficient fixing performance by flexibly responding to each processing mode.

A fixing apparatus according to the present invention is a fixing apparatus of an image forming apparatus in which a color processing mode or a monochrome processing mode can be selected in print processing, the fixing apparatus comprising: a heat roller and a pressure roller that, by sandwiching therebetween a sheet of recording paper on which a development image has been transferred and rotating, transport the sheet of recording paper and carry out application of heat and application of pressure on the sheet of recording paper, wherein a pressing force of a nip area, which is a contact area between the heat roller and the pressure roller, can be varied in response to the processing mode. Specifically, the pressing force of the nip area is set to a first predetermined pressure during the color processing mode and is set to a second predetermined pressure higher than the first predetermined pressure during the monochrome processing mode.

That is, during the color processing mode in which sheets are passed with a slow speed, fixing is carried out with a narrow nip width by setting the pressing force of the nip area to the first predetermined pressure (relatively low pressure), and during the monochrome processing mode in which sheets are passed with a fast speed, fixing is carried out with a wide nip width by setting the pressing force of the nip area to the second predetermined pressure (relatively high pressure). In this way, the problem of an insufficient amount of heat is addressed by lengthening the time in which the sheets of recording paper are in contact with the nip area. Thus, stable fixing processing can be carried out in each processing mode.

Here, the pressing force of the nip area may be set to the second predetermined pressure corresponding to the monochrome processing mode at a normal time, and may be changed from the second predetermined pressure to the first predetermined pressure at a time of the color processing mode. When considering the usage conditions of image forming apparatuses, in an ordinary household monochrome printing is used much more than color printing for example. And in the case of usage in an office, monochrome printing is used more than color printing. In view of such usage conditions, it is effective to set the usual standby status to the monochrome processing mode. And when the usual standby status is set to the monochrome processing mode, the contact pressure of both rollers is relatively high and the nip width is also relatively wide, and therefore the thermal conductivity from the heat roller to the pressure roller is improved. Consequently, even when a heater is mounted inside the pressure roller itself, the heating time of that heater can be shortened by a corresponding amount, and therefore power consumption as a whole can be suppressed.

Furthermore, a fixing apparatus according to the present invention may be further provided with a pressure application mechanism portion that causes a movement of pressing the pressure roller against the heat roller so as to change from the second predetermined pressure to the first predetermined pressure at a time of the color processing mode. The pressure application mechanism portion may be configured to cause a movement of pressing the pressure roller such that a contact region of the nip area in a direction perpendicular to a recording paper transport direction is substantially uniformly increased by increasing the pressing force.

Furthermore, the pressure application mechanism portion may be configured to cause a movement of pressing the pressure roller such that a contact region of the nip area in a direction perpendicular to a recording paper transport direction is increased on a downstream side of the recording paper transport direction by increasing the pressing force. When configured in this manner, the contact point (the insertion point of the nip area) of the heat roller and the pressure roller on the side where the leading edge portion of a sheet of recording paper enters the nip area does not move in a direction perpendicular to the recording paper transport direction even though the pressing force changes, and therefore the distance from where the leading edge portion of the sheet of recording paper makes contact with the heat roller until where it is inserted to the nip area is kept constant. That is, insertion of the sheet of recording paper to the nip area can be carried out stably.

DESCRIPTION OF THE PREFERRED EMBODIMENTS

Hereinafter, embodiments of the present invention are described with reference to the accompanying drawings.

<Overall Description of Image Forming Apparatus>

First, an overall structure of an image forming apparatus to which the present invention is applied is described.

Figure 1:
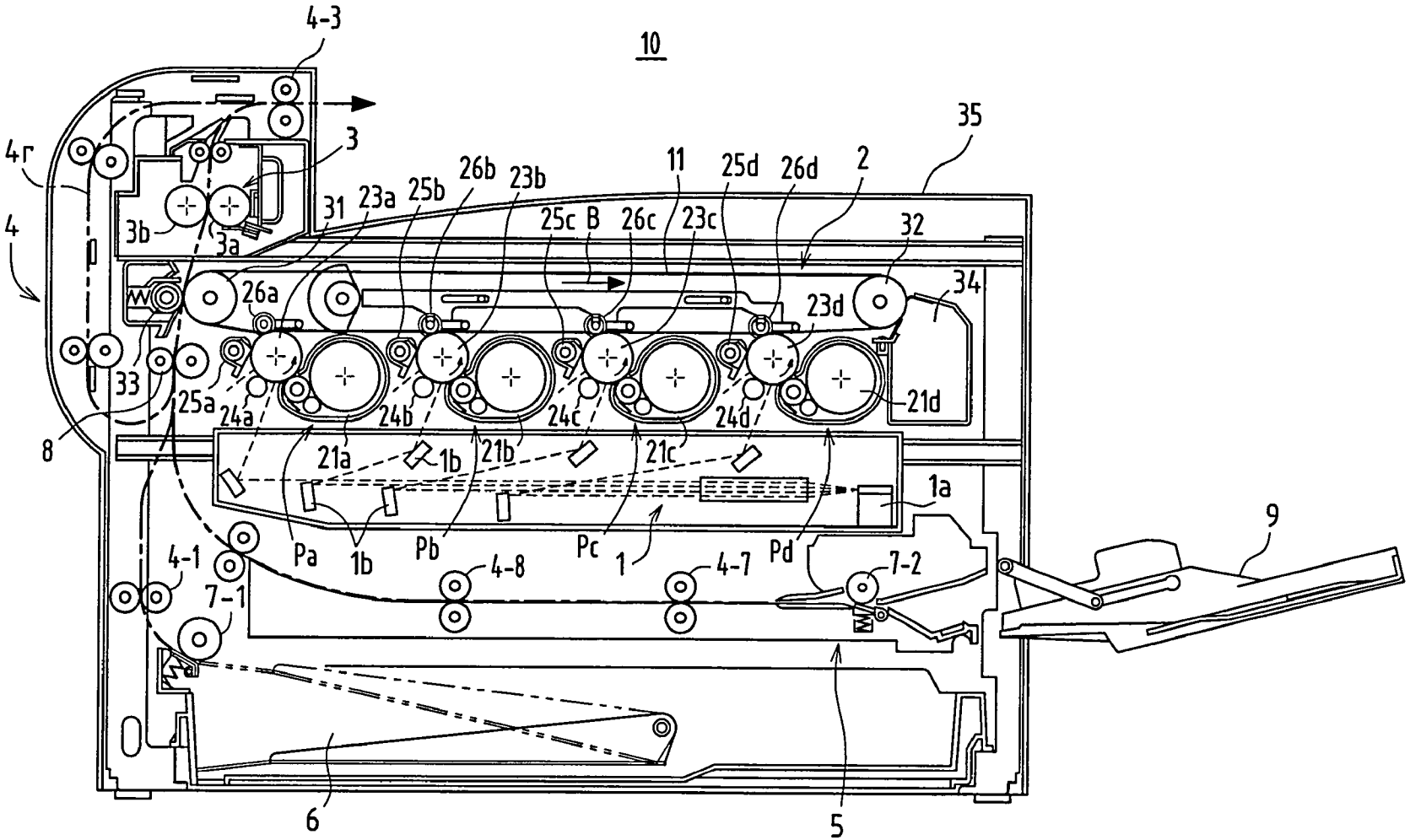
FIG. 1 is a lateral view of an image forming apparatus in which one embodiment of a fixing apparatus according to the present invention has been applied.

FIG. 1 is a lateral view of an image forming apparatus in which one embodiment of a fixing apparatus according to the present invention has been applied.

An image forming apparatus 10 is a color laser printer that records a color image on a sheet of recording paper and is provided with items such as an exposing apparatus 1, image forming stations Pa, Pb, Pc, and Pd, an intermediate transfer belt apparatus 2, a fixing apparatus 3, a paper transport apparatus 4, and a paper feed apparatus 5.

The image forming stations Pa, Pb, Pc, and Pd form toner images of black (K), cyan (C), magenta (M), and yellow (Y) respectively, and the toner image of each color is transferred to an intermediate transfer belt 11 of the intermediate transfer belt apparatus 2. The image forming stations Pa, Pb, Pc, and Pd are provided with items including development apparatuses 21*a* to 21*d*, photosensitive drums 23*a* to 23*d*, charging units 24*a* to 24*d*, and cleaning units 25*a* to 25*d*.

The photosensitive drums 23*a* to 23*d* press on primary transfer rollers 26*a* to 26*d* respectively with interposition of the intermediate transfer belt 11 and rotate with the intermediate transfer belt 11 at a peripheral speed equivalent to the intermediate transfer belt 11, which rotationally moves in the direction of arrow B. Furthermore, the primary transfer rollers 26*a* to 26*d* also rotate following the intermediate transfer belt 11 at a peripheral speed equivalent to the intermediate transfer belt 11, which rotationally moves in the direction of arrow B.

The charging units 24*a* to 24*d* are roller-type or brush-type units that contact the photosensitive drums 23*a* to 23*d*, or charger-type devices, and uniformly charge the surfaces of the photosensitive drums 23*a* to 23*d*.

The exposing apparatus 1 is provided with a laser light source 1*a* that irradiates laser light toward the respective photosensitive drums 23*a* to 23*d* and a plurality of mirrors 1*b* that guide the laser light onto the respective photosensitive drums 23*a* to 23*d*. The laser lights are irradiated onto the surfaces of the respective photosensitive drums 23*a* to 23*d* while being modulated in accordance with the image data, such that respective electrostatic latent images are formed on the surfaces of the respective photosensitive drums 23*a* to 23*d*.

It should be noted that a writing head in which light-emitting elements such as ELs and LEDs are arranged in an array may be used as the exposing apparatus 1.

The development apparatuses 21*a* to 21*d* store toner of their respective colors and form toner images of these colors on the surfaces of the photosensitive drums 23*a* to 23*d* by causing toner of these colors to adhere to the electrostatic latent images on the surfaces of the photosensitive drums 23*a* to 23*d*. These toner images are transferred from the photosensitive drums 23*a* to 23*d* and superimposed on the intermediate transfer belt 11.

The intermediate transfer belt apparatus 2 is provided with items such as the intermediate transfer belt 11, the primary transfer rollers 26*a* to 26*d*, a drive support roller 31, an idler support roller 32, and a secondary transfer roller 33. The intermediate transfer belt 11 is rotatably supported by being wound around the drive support roller 31 and the idler support roller 32, and the primary transfer rollers 26*a* to 26*d* and the secondary transfer roller 33 are pressed against the intermediate transfer belt 11.

The intermediate transfer belt 11 is made of a synthetic resin film of a thickness in the range of 100 μm to 150 μm for example. The secondary transfer roller 33 is supported so as to be movable laterally, and when it is moved rightward it sandwiches the intermediate transfer belt 11 between the secondary transfer roller 33 and the drive support roller 31 and forms a nip area. The drive support roller 31 fulfills a role of being a backup roller of the secondary transfer roller 33 and is driven to rotate in the downstream of the respective nip areas between the primary transfer rollers 26*a* to 26*d* and the photosensitive drums 23*a* to 23*d* so that the intermediate transfer belt 11 is pulled and made to rotationally move in a direction of arrow B. In this way, the nip areas are maintained stably.

It should be noted that, of the primary transfer rollers 26*a* to 26*d* and the photosensitive drums 23*a* to 23*d*, it is preferable for one of these to be formed of a hard material and the other to be formed of an elastic material in order to more stably form the respective nip areas between the primary transfer rollers 26*a* to 26*d* and the photosensitive drums 23*a* to 23*d*.

Each of the primary transfer rollers 26*a* to 26*d* is made of a metal shaft of a diameter in the range of 8 mm to 10 mm for example, the circumference of which is covered by a conductive elastic material (such as EPDM and urethane foam). With the intermediate transfer belt 11 sandwiched in the nip areas between the primary transfer rollers 26*a* to 26*d* and the photosensitive drums 23*a* to 23*d*, a bias voltage having a polarity opposite to the charged polarity of the toners is applied to the primary transfer rollers 26*a* to 26*d* such that the respective electrical fields are effected with interposition of the intermediate transfer belt 11 to the toner on the surfaces of the photosensitive drums 23*a* to 23*d*, such that the toner on the surfaces of the photosensitive drums 23*a* to 23*d* is attracted and transferred to the intermediate transfer belt 11. Thus, the toner images of respective colors are transferred to the intermediate transfer belt 11 and superimposed.

It should be noted that brushes or the like may be used instead of rollers as the primary transfer rollers 26*a* to 26*d*.

A cleaning apparatus 34 includes, for example, a cleaning blade that slides in contact with the surface of the intermediate transfer belt 11, and removes toner remaining on the surface of the intermediate transfer belt 11 to prevent such defects as fogging of the next image to be printed.

In this way, the toner images of respective colors that are transferred and superimposed onto the intermediate transfer belt 11 are transported to the nip area between the drive support roller 31 and the secondary transfer roller 33 in accordance with rotational movement of the intermediate transfer belt 11. Then, a leading edge of the toner image of the colors on the intermediate transfer belt 11 and a leading edge of the sheet of recording paper transported by a registration roller 8 are aligned, and the toner image of the colors and the sheet of recording paper are superimposed so that the toner image of the colors is transferred to the sheet of recording paper.

After transfer, the sheet of recording paper is transported to the fixing apparatus 3 and is here sandwiched between a heat roller 3*a* and a pressure roller 3*b*. Thus, the toner of the colors on the sheet of recording paper is thermally melted and mixed so that the toner image of the colors is fixed to the sheet of recording paper as a color image.

After fixing, the sheet of recording paper is transported to a discharge tray 35 by the paper transport apparatus 4 and discharged here facedown.

On the other hand, in the image forming apparatus 10, the sheets of recording paper are stacked and stored in a paper feed cassette 6. In the paper transport apparatus 4, sheets of recording paper in the paper feed cassette 6 are drawn out sheet by sheet by a pickup roller 7-1 and the sheets of recording paper are transported to the registration roller 8 by transport rollers 4-1.

Also, sheets of recording paper are loaded in a manual paper feed tray 9. In the paper feed apparatus 5, sheets of recording paper in the manual paper feed tray 9 are drawn out by a pickup roller 7-2 and the sheets of recording paper are transported to the registration roller 8 of the paper transport apparatus 4 by transport rollers 4-7 and 4-8.

In the paper transport apparatus 4, the sheet of recording paper is temporarily stopped by the registration roller 8, the leading edge of the sheet of recording paper is aligned, and the sheet of recording paper is transported to the secondary transfer roller 33 by the registration roller 8 with a timing such that the leading edge of the sheet of recording paper overlaps the leading edge of the toner image formed on the intermediate transfer belt 11 of the intermediate transfer belt apparatus 2.

It should be noted that it is also possible to use only the image forming station Pa to form a monochrome image and transfer the monochrome image to the intermediate transfer belt 11 of the intermediate transfer belt apparatus 2. As with the color image, the monochrome image is transferred from the intermediate transfer belt 11 to the sheet of recording paper and fixed to the sheet of recording paper.

Furthermore, when carrying out printing not only on the front side of the sheet of recording paper but on both sides, after the image on the front side of the sheet of recording paper is fixed by the fixing apparatus 3 and while transport rollers 4-3 of the paper transport apparatus 4 are transporting the sheet of recording paper, the transport rollers 4-3 can be made to stop and then rotate in reverse. The front and back of the sheet of recording paper are reversed by passing through a reverse path 4*r* of the paper transport apparatus 4, then the sheet of recording paper is guided to the registration roller 8 and an image is recorded and fixed on the back side of the sheet of recording paper in the same way as the front side of the sheet of recording paper, after which the sheet of recording paper is discharged to the discharge tray 35.

<Description of Basic Configuration of Fixing Apparatus 3>

Figure 2:
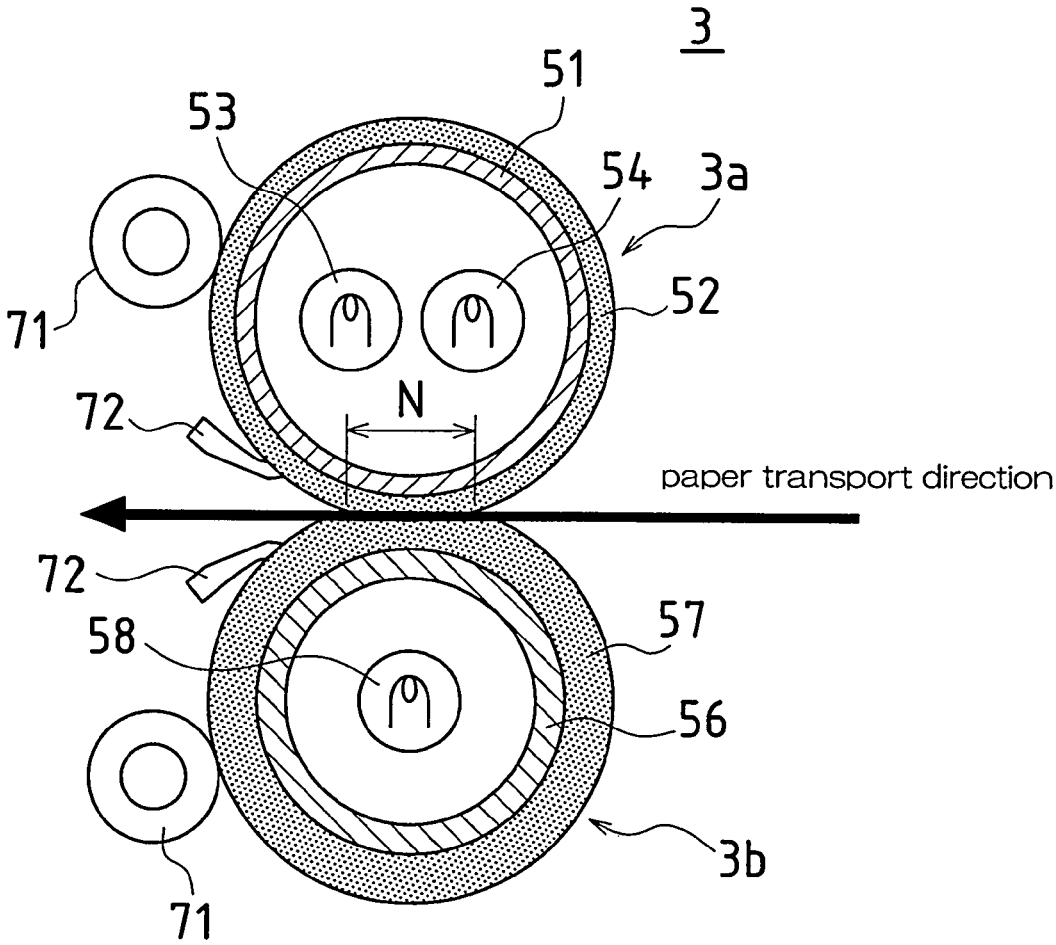
FIG. 2 is a transverse cross-sectional view showing a vertical cross section of a heat roller and a pressure roller of the fixing apparatus according to the present embodiment.
Figure 3:
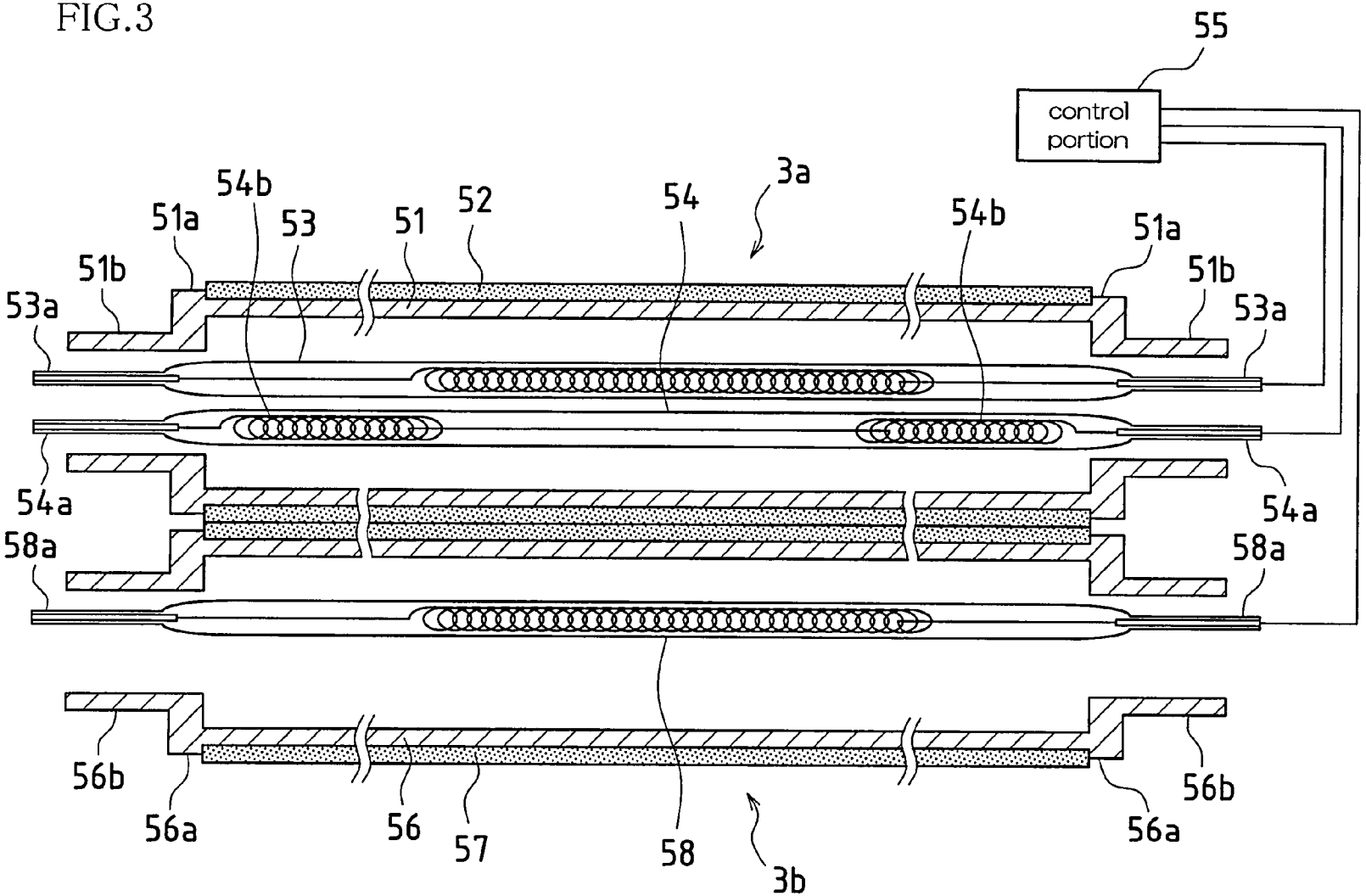
FIG. 3 is a longitudinal cross-sectional view showing a horizontal cross section of the heat roller of the fixing apparatus shown in FIG. 2.

Next, a basic configuration of the fixing apparatus 3 of the present embodiment is described. FIG. 2 is a transverse cross-sectional view showing a vertical cross section of the heat roller 3*a* and the pressure roller 3*b* of the fixing apparatus 3, and FIG. 3 is a longitudinal cross-sectional view showing a horizontal cross section of the heat roller 3*a* of the fixing apparatus 3.

In the fixing apparatus 3 of the present embodiment, the heat roller 3*a* and the pressure roller 3*b* are axially supported to be freely rotatable and a nip area N is formed to sandwich the sheet of recording paper between the rollers 3*a* and 3*b* by pressing the rollers 3*a* and 3*b* against each other. Then, when one of the heat roller 3*a* and the pressure roller 3*b* is driven to rotate, the other follows and rotates, thereby introducing the sheet of recording paper to the nip area N between the rollers 3*a* and 3*b*, and pressure and heat are applied to the sheet of recording paper by the rollers 3*a* and 3*b*. Thus, as described earlier, the toner of the colors on the sheet of recording paper is thermally melted and mixed so that the toner image of the colors is fixed to the sheet of recording paper as a color image.

Furthermore, by pushing cleaning rollers 71 and 71 against the surfaces of the heat roller 3*a* and the pressure roller 3*b* respectively, the toner, paper dust and the like adhering to the surfaces of the rollers 3*a* and 3*b* are removed.

Further still, by pushing paper separating claws 72 and 72 against the surfaces of the heat roller 3*a* and the pressure roller 3*b* respectively, the sheet of recording paper is peeled off from the surfaces of the rollers 3*a* and 3*b*, which prevents sheets of recording paper from winding onto the rollers 3*a* and 3*b*.

The heat roller 3*a* is a component in which a circumferential surface of a metal cylinder 51 is covered by an elastic layer 52 made of $SiO_2$ rubber. Flanges 51*a* are provided at both edges of the cylinder 51 respectively and the elastic layer 52 is arranged between the flanges 51*a*. Furthermore, pipe shaped rotating shafts 51*b* are provided protruding from a center of the flanges 51*a* of the cylinder 51 respectively, with these rotating shafts 51*b* being axially supported to be rotatable. Further still, a main heater 53 and a sub-heater 54 are arranged along a longitudinal direction of the heat roller 3*a* inside the cylinder 51, and the heat roller 3*a* is heated by heat produced by the main heater 53 or the sub-heater 54. Terminals 53*a* at the ends of the main heater 53 and terminals 54*a* at the ends of the sub-heater 54 are connected through the rotating shafts 51*b* to a control portion 55.

As with the heat roller 3*a*, the pressure roller 3*b* is also a component in which a circumferential surface of a metal cylinder 56 is covered by an elastic layer 57 made of $SiO_2$ rubber. As with the cylinder 51 of the heat roller 3*a*, the cylinder 56 is provided with flanges 56*a* at its edges and pipe shaped rotating shafts 56*b*, with the rotating shafts 56*b* being axially supported to be rotatable. Furthermore, a single heater 58 is arranged along a longitudinal direction of the pressure roller 3*b* inside the cylinder 56, and the pressure roller 3*b* is heated by heat produced by the heater 58. Terminals 58*a* at the ends of the heater 58 are also connected through the rotating shafts 56*b* of the cylinder 56 to the control portion 55. The heater 58 heats substantially the entire pressure roller 3*b* and uniformly raises the surface temperature of the pressure roller 3*b*. It should be noted that the heater 58 of the pressure roller 3*b* is sometimes not provided depending on such factors as the specifications of the image forming apparatus.

The foregoing has been a description of the basic configuration of the fixing apparatus 3.

Description of Fixing Apparatus According to Present Embodiment

With the present embodiment in the above-described configuration, the pressing force of the nip area N, which is a contact area between the heat roller 3*a* and the pressure roller 3*b*, can be varied between color processing mode to carry out color printing and monochrome processing mode to carry out monochrome printing. Specifically, at the time of color processing mode, the pressing force of the nip area N is lowered to narrow the nip width, and at the time of monochrome processing mode, the pressing force of the nip area N is raised to widen the nip width. Here, in the present embodiment, the position of the heat roller 3*a* is fixed and the pressure roller 3*b* is made to approach or move away from the heat roller 3*a*, thereby varying the pressing force and varying the nip width. Furthermore, in the present embodiment, a positional relationship between the heat roller 3*a* and the pressure roller 3*b* at the time of monochrome processing mode is set as a normal position (that is, a home position), and a pressure application mechanism portion 100 is provided by which a movement is performed so that the pressure roller 3*b* is moved away from the heat roller 3*a* by a predetermined distance with respect to this positional relationship at the time of color processing mode, and after color processing mode is finished, a movement is performed so that the pressure roller 3*b* is made to approach the heat roller 3*a* again and return to the home position. It should be noted that the pressure application mechanism portion 100 is described in detail later.

Figure 4A:
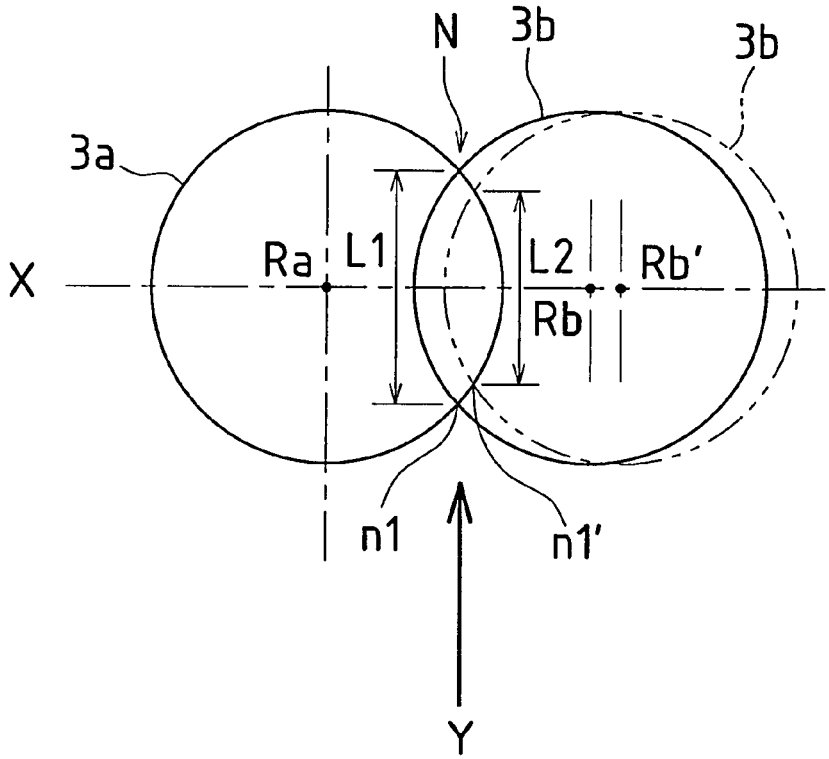
FIGS. 4(*a*) and 4(*b*) are explanatory diagrams illustrating two types of movement techniques for causing the pressure roller to approach and move away from the heat roller.
Figure 4B:
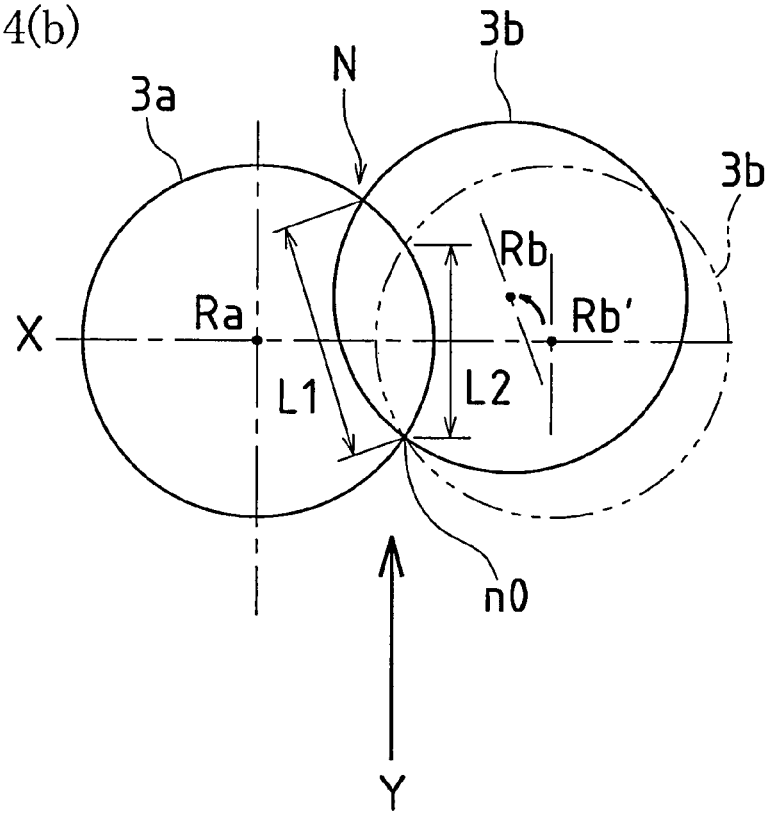

Here, two movement techniques are shown in FIG. 4(*a*) and FIG. 4(*b*) as movement techniques for causing the pressure roller 3*b* to approach or move away from the heat roller 3*a*.

That is, a rotational center Ra of the rotating shaft of the heat roller 3*a* and a rotational center Rb of the rotating shaft of the pressure roller 3*b* are arranged along a direction (hereinafter referred to as "horizontal direction") X that is perpendicular to a paper transport direction Y, and in FIG. 4(*a*), the pressure roller 3*b* is caused to approach and move away from the heat roller 3*a* by causing the rotational center Rb of the pressure roller 3*b* to move in a lateral direction along the horizontal direction X. In FIG. 4(*a*), a position (rotational center Rb) of the pressure roller 3*b* shown by a solid line is the home position corresponding to the monochrome processing mode and the width of the nip area N at this time is shown as L1. In contrast to this, a position (rotational center Rb') of the pressure roller 3*b* shown by a dashed double-dotted line (imaginary line) is the position corresponding to the color processing mode and the width of the nip area N at this time is shown as L2. That is, when the width L1 of the nip area N at the time of the monochrome processing mode is set to the width of the nip area N for normal times, the width L2 of the nip area N at the time of the color processing mode is a narrower width than L1.

Here, in the movement technique shown in FIG. 4(*a*), since the pressure roller 3*b* moves along the horizontal direction X, the position of the nip area N is also slightly displaced laterally with respect to the paper transport direction Y. Consequently, insertion points n1 and n1' of the leading edge portion of the sheet of recording paper to the nip area N change between the color processing mode and the monochrome processing mode.

For this reason, when for example the insertion point of the leading edge portion of the sheet of recording paper to the nip area N is set to (n1) so as to be appropriate during the monochrome processing mode, the insertion point n1' to the nip area N during the color processing mode becomes farther, and therefore the distance from where the leading edge portion of the sheet of recording paper contacts the surface of the heat roller 3*a* on the left side until it is guided to the insertion point n1' becomes longer, such that during this time there is a possibility of bending of the leading edge portion of the sheet of recording paper and positional displacement from the insertion point n1' of the nip area N. On the other hand, when the insertion point of the leading edge portion of the sheet of recording paper to the nip area N is set to (n1') so as to be appropriate during the color processing mode, the insertion point n1 to the nip area N during the monochrome processing mode becomes closer, and therefore the distance from where the leading edge portion of the sheet of recording paper contacts the surface of the heat roller 3*a* on the left side until it is guided to the insertion point n1 becomes shorter, such that there is a possibility that the leading edge portion of the sheet of recording paper is not guided smoothly to the insertion point n1 of the nip area N, and an undulating movement of the sheet of recording paper due to collision at the insertion point n1 affects the preceding transfer process and causes transfer displacement.

A movement technique that addresses these problems is shown in FIG. 4(*b*).

In FIG. 4(*b*), to ensure that an insertion point n0 of the nip area N does not move, the pressure roller 3*b* is made to approach the heat roller 3*a* by rotating the rotational center from Rb' to Rb and the pressure roller 3*b* is made to move away from the heat roller 3*a* by rotating the rotational center from Rb to Rb'. In this case, in FIG. 4(*b*), a position (rotational center Rb) of the pressure roller 3*b* shown by a solid line is the home position corresponding to the monochrome processing mode and the width of the nip area N at this time is shown as L1. In contrast to this, a position (rotational center Rb') of the pressure roller 3*b* shown by a dashed double-dotted line is the position corresponding to the color processing mode and the width of the nip area N at this time is shown as L2. That is, when the width L1 of the nip area N at the time of the monochrome processing mode is set to the width of the nip area N for normal times, the width L2 of the nip area N at the time of the color processing mode is a narrower width than L1.

Here, in the movement technique shown in FIG. 4(*b*), since the pressure roller 3*b* is subjected to a rotational movement centered on the insertion point n0 of the nip area N, the position of the insertion point n0 of the nip area N is always kept constant with respect to the paper transport direction Y. Thus, the above-described problems that can occur due to the movement operation shown in FIG. 4(*a*) do not occur. That is, the leading edge portion of the sheet of recording paper can be made to enter the nip area N smoothly regardless of the processing mode.

Figure 5:
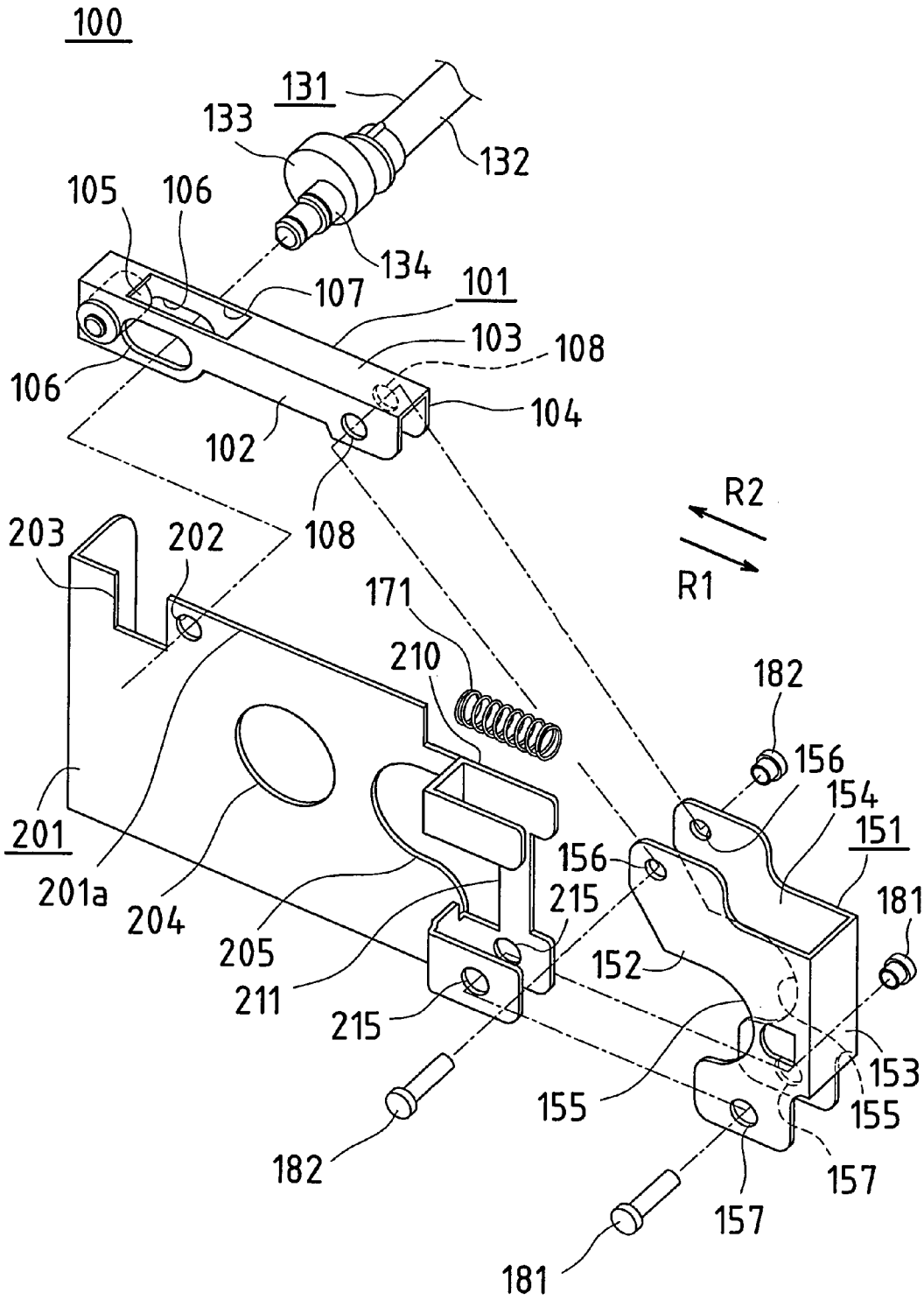
FIG. 5 is an exploded perspective view of the pressure application mechanism portion.
Figure 6:
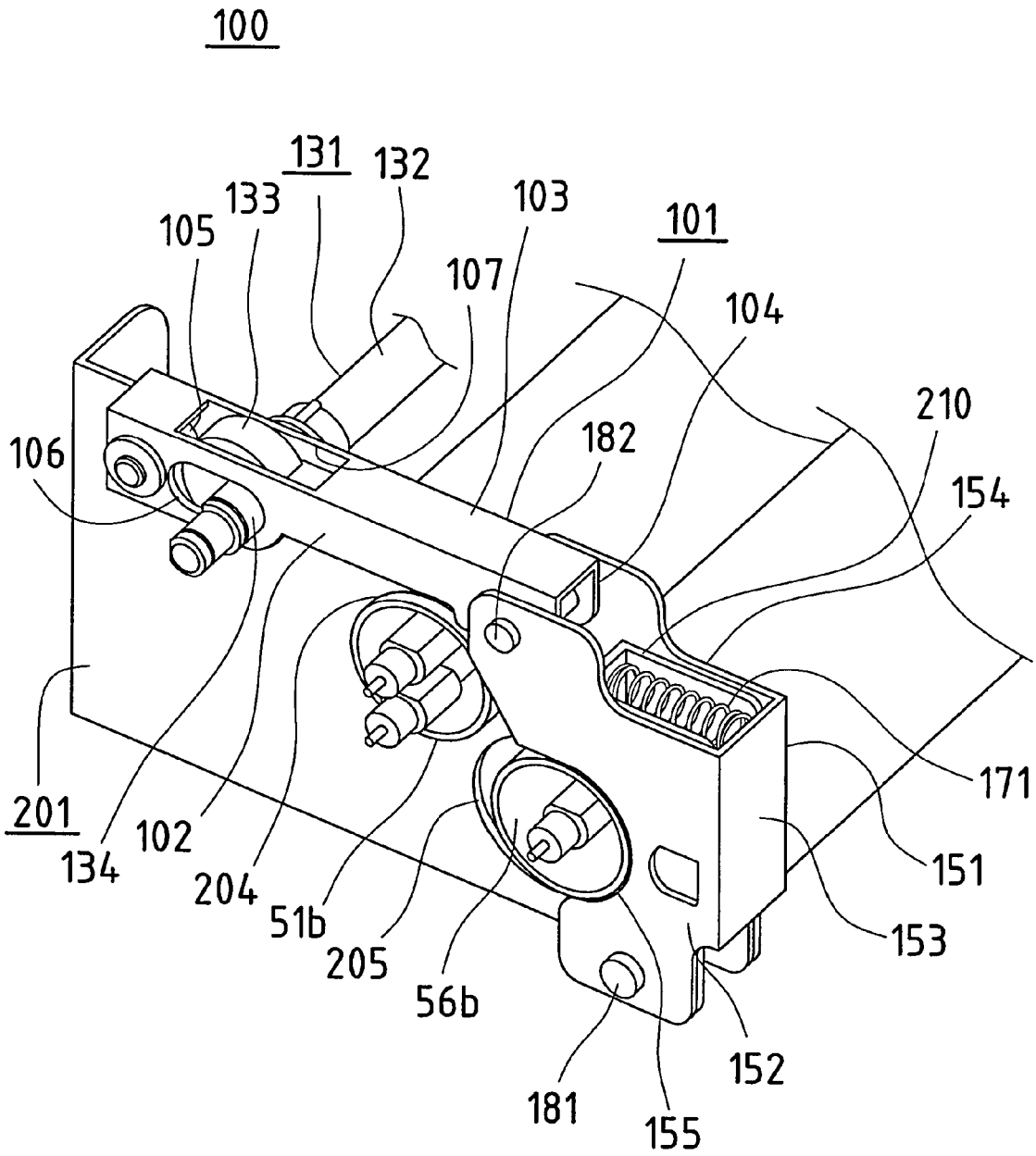
FIG. 6 is a perspective view showing an assembled state of the pressure application mechanism portion shown in FIG. 5.
Figure 7A:
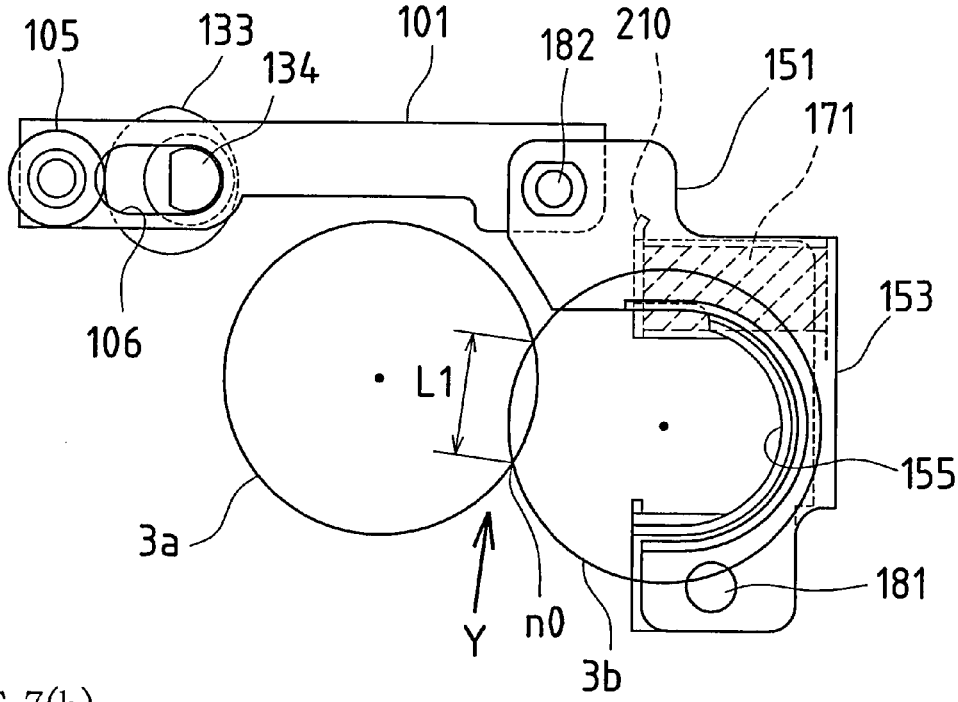
FIGS. 7(*a*) and 7(*b*) are schematic views of the pressure application mechanism portion as viewed from a lateral plane.
Figure 7B:
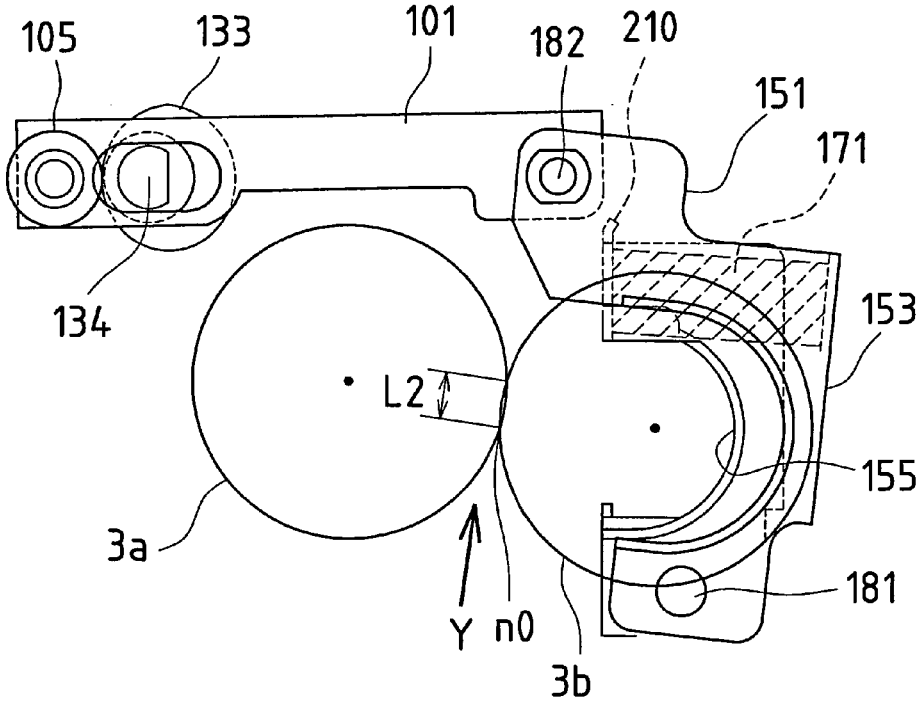

FIG. 5 to FIG. 7(*b*) show a detailed configuration of the pressure application mechanism portion 100 for achieving the movement technique shown in FIG. 4(*b*). FIG. 5 is an exploded perspective view. FIG. 6 is a perspective view showing an assembled state. FIGS. 7(*a*) and 7(*b*) are schematic views as viewed from a lateral plane. It should be noted that the pressure application mechanism portions 100 are arranged at the rotating shafts 51*b* and 56*b* respectively of the left and right sides of the heat roller 3*a* and the pressure roller 3*b*, but only one side is shown in FIG. 6.

As shown in FIG. 5, the pressure application mechanism portion 100 is broadly divided into a pressure-varying link structure 101 provided so as to be movable in lateral directions R1 and R2 along an upper end portion 201*a* of a device frame 201, a drive shaft 131 having an eccentric cam 133 for moving the pressure-varying link structure 101 in the lateral directions R1 and R2, a shaft holding structure 151 provided so as to be rotatable coupled to the pressure-varying link structure 101, and a coil spring 171 for applying a biasing force to the shaft holding structure 151 in a rightward direction R1 along the upper end portion 201*a* of the device frame 201. First, these structural members are described separately.

The drive shaft 131 is provided with a large-diameter first drive shaft 132 that is coupled at a back end portion to a step motor or the like not shown in the drawings, the eccentric cam 133 integrally formed at a front end portion (front side in FIG. 5) of the first drive shaft 132, and a small-diameter second drive shaft 134 that protrudes forward (front side in FIG. 5) from a lateral surface of the eccentric cam 133.

Provided in a vicinity of the upper end portion 201*a* on the left side of the device frame 201 is a first support hole 202 into which the first drive shaft 132 is rotatably inserted and supported, and further left from the first support hole 202 is formed a cutout portion 203 having a predetermined width and predetermined depth from the upper end portion 201*a*. Furthermore, provided in a central area of the device frame 201 is a second support hole 204 into which the rotating shaft 51*b* of the heat roller 3*a* is rotatably inserted and supported, and moreover in a right side vicinity of the second support hole 204 is provided an opening portion 205 for enabling the rotating shaft 56*b* of the pressure roller 3*b* to be movably inserted.

Furthermore, a pressure plate 210, which has been formed as a square-cornered "C" shape such that its upper area and lower area are open on the right side, is integrally fastened at a right end of the device frame 201, and a cutout portion 211 is formed in a central area of the pressure plate 210 so as to connect to the opening portion 205 formed in the device frame 201. Further still, shaft insertion holes 215 are formed in the square-cornered "C" shaped lower area of the pressure plate 210 into which a connecting shaft (male side shaft and female side shaft) 181 is inserted and supported for rotatably supporting the shaft holding structure 151, which is described later.

The pressure-varying link structure 101 is formed by a front side plate 102, an upper surface plate 103, and a rear side plate 104 to make a downward facing "C" shape in transverse cross section and is arranged in a fitted state straddling the upper end portion 201*a* of the device frame 201. A cylinder shaped contact structure 105 is provided between the front side plate 102 and the rear side plate 104 on the left end side of the pressure-varying link structure 101 to suppress movement of the pressure-varying link structure 101 by being in constant contact with the eccentric cam 133. Furthermore, laterally elongated holes 106 are formed in the front side plate 102 and the rear side plate 104 further rightward from the contact structure 105, which is on the left end side of the pressure-varying link structure 101, and an opening portion 107 is formed on the upper surface plate 103. The opening portion 107 is provided to secure a clearance region of the eccentric cam 133 so as to not hinder the rotational movement of the eccentric cam 133. Further still, shaft insertion holes 108 are provided at the front side plate 102 and the rear side plate 104 on the right end side of the pressure-varying link structure 101 into which a connecting shaft (male side shaft and female side shaft) 182 is inserted and supported for connecting to the shaft holding structure 151.

The shaft holding structure 151 is formed by a front side plate 152, a pressure receiving plate 153, and a rear side plate 154 to make a square-cornered "C" shape and an opening portion thereof is arranged so as to be in opposition to an opening portion of the pressure plate 210. A cutout portion (shaft holding portion) 155 formed in a substantial half circular arc is provided on opening side edge portions of the front side plate 152 and the rear side plate 154 of the shaft holding structure 151 to hold the rotating shaft 56*b* of the pressure roller 3*b*. Furthermore, shaft insertion holes 156 are provided at the front side plate 152 and the rear side plate 154 on the upper end portion of the shaft holding structure 151 into which the connecting shaft 182 is inserted and supported for connecting to the pressure-varying link structure 101. Further still, shaft insertion holes 157 are provided at the front side plate 152 and the rear side plate 154 on the lower end portion of the shaft holding structure 151 into which the connecting shaft 181 is inserted and supported for rotatably supporting the pressure plate 210.

In the pressure application mechanism portion 100 of the present embodiment in the above-described structure, the first drive shaft 132 is rotatably inserted and supported in the first support hole 202 of the device frame 201, and in this state the pressure-varying link structure 101 fits so as to contain the eccentric cam 133 of the drive shaft 131 and to straddle the upper end portion 201*a* of the device frame 201. At this time, the second drive shaft 134 of the drive shaft 131 is inserted into the two elongated holes 106 and 106 of the pressure-varying link structure 101 and the eccentric cam 133 is arranged so as to touch the contact structure 105. It should be noted that the contact structure 105 fits into a location of the cutout portion 203 provided in the device frame 201. Further still, the positions of the shaft insertion holes 108 of the pressure-varying link structure 101 and the shaft insertion holes 156 of the shaft holding structure 151 are aligned and rotatably linked by the connecting shaft 182. Next, the positions of the shaft insertion holes 215 of the pressure plate 210 and the shaft insertion holes 157 of the shaft holding structure 151 are aligned and rotatably linked by the connecting shaft 181. Then, the coil spring 171 is mounted in a compressed state between the pressure plate 210 and the pressure receiving plate 153 of the shaft holding structure 151. Further still, when the rotating shaft 51*b* of the heat roller 3*a* is inserted and held in the second support hole 204 of the device frame 201 and the rotating shaft 56*b* of the pressure roller 3*b* is inserted and held in the opening portion 205 of the device frame 201 and the cutout portion (shaft holding portion) 155 of the shaft holding structure 151, the pressure application mechanism portion 100 is constructed having a structure illustrated in FIG. 6.

It should be noted that it is in fact impossible to attach the pressure-varying link structure 101 as it is, but by dividing the pressure-varying link structure 101 into two front and rear parts for example and combining the two parts into one whole after mounting, the above-described structure can be obtained. Also, the order in which each member is attached to the device frame 201 is not necessarily the above-described order, and attachments can be carried out in the most efficient order for the manufacturing process.

With this structure, the shaft holding structure 151 is configured to be always biased by the coil spring 171 toward the right side in the drawing and the biasing force is impeded by contacting the eccentric cam 133 of the drive shaft 131 and the contact structure 105 provided in the pressure-varying link structure 101. Accordingly, the contact position of the contact structure 105 to the eccentric cam 133 is changed by driving the drive shaft 131 to rotate the eccentric cam 133, and the pressure-varying link structure 101 moves in the R1 or R2 direction shown in FIG. 5 accompanying this change. Then, accompanying the movement of the pressure-varying link structure 101, the shaft holding structure 151 rotates centered on the axis of the connecting shaft 181, a result of which is that a rotational movement is carried out in which the rotating shaft 56*b* of the pressure roller 3*b* being held by the shaft holding structure 151 approaches and moves away from the rotating shafts 51*b* of the heat roller 3*a*. FIGS. 7(*a*) and 7(*b*) show conditions at this time. It should be noted that a ball bearing type shaft bearing structure may be used for the outer circumferential surface of the contact structure 105 so that the rotational movements of the eccentric cam 133 can be carried out smoothly.

FIG. 7(*a*) shows a condition in which the largest swollen portion of the eccentric cam 133 is contacting the contact structure 105 and shows a condition in which the pressure-varying link structure 101 has moved farthest to the left side. That is, a condition is shown in which the pressure roller 3*b* is pressed against the heat roller 3*a* the most strongly, the condition at this time being a condition shown by the solid line in FIG. 4(*b*). In other words, this is a condition in which the nip width of the nip area N is L1.

On the other hand, FIG. 7(*b*) shows a condition in which the eccentric cam 133 of FIG. 7(*a*) has rotated 180°, that is, a condition in which the largest swollen portion of the eccentric cam 133 is positioned on an opposite side to the contact structure 105, and a condition in which the pressure-varying link structure 101 has moved farthest to the right side. That is, a condition is shown in which the pressure roller 3*b* is farthest apart from the heat roller 3*a*, the condition at this time being a condition shown by the dashed double-dotted line in FIG. 4(*b*). In other words, this is a condition in which the nip width of the nip area N is L2.

It should be noted that in order to cause rotation of the rotational center Rb (Rb') of the pressure roller 3*b* such that the insertion point n0 of the nip area N does not move as shown in FIG. 4(*b*), giving consideration to the paper transport direction, adjustment should be carried out of the positional relationships of three points, namely the rotational center Ra of the heat roller 3*a*, the rotational center Rb (Rb') of the pressure roller 3*b*, and the rotational center (axis of the connecting shaft 181) of the shaft holding structure 151.

Furthermore, in the above-described embodiment, by arranging the pressure-varying link structure 101 straddling the upper end portion 201*a* of the device frame 201, a configuration is achieved that prevents longitudinal wobbling when the pressure-varying link structure 101 moves in a lateral direction, but it is not absolutely necessary for the pressure-varying link structure 101 to be arranged straddling the device frame 201, and may be arranged along one side (the front side in FIG. 5) of the device frame 201.

Furthermore, in regard to the structure of the pressure application mechanism portion 100 for achieving the movement technique shown in FIG. 4(*a*), this can be easily achieved by employing the pressure application mechanism portion 100 shown in FIGS. 5 to 7(*b*). That is, this structure can be achieved by arranging the drive shaft 131, the pressure-varying link structure 101, and the coil spring 171 arranged on the upper end portion 201*a* of the device frame 201 also on a lower end portion side, and by making the connecting structure on the lower side of the shaft holding structure 151 be the same structure as a connecting structure on the upper side.

The present invention can be embodied and practiced in other different forms without departing from the gist and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A fixing apparatus of an image forming apparatus in which a color processing mode or a monochrome processing mode can be selected in print processing, the fixing apparatus comprising:

a heat roller and a pressure roller that, by sandwiching therebetween a sheet of recording paper on which a development image has been transferred and rotating, transport the sheet of recording paper and carry out application of heat and application of pressure on the sheet of recording paper, wherein a pressing force of a nip area, which is a contact area between the heat roller and the pressure roller, can be varied in response to the processing mode, and the pressing force of the nip area is set to a first predetermined pressure during the color processing mode and is set to a second predetermined pressure higher than the first predetermined pressure during the monochrome processing mode.

2. The fixing apparatus according to claim 1, wherein the pressing force of the nip area is set to the second predetermined pressure corresponding to the monochrome processing mode at a normal time, and is changed from the second predetermined pressure to the first predetermined pressure at a time of the color processing mode.

3. The fixing apparatus according to claim 2, further comprising a pressure application mechanism portion that causes a movement of pressing the pressure roller against the heat roller so as to change from the second predetermined pressure to the first predetermined pressure at a time of the color processing mode.

4. The fixing apparatus according to claim 3, wherein the pressure application mechanism portion causes a movement of pressing the pressure roller such that a contact region of the nip area in a direction perpendicular to a recording paper transport direction is substantially uniformly increased by increasing the pressing force.

5. The fixing apparatus according to claim 3, wherein the pressure application mechanism portion causes a movement of pressing the pressure roller such that a contact region of the nip area in a direction perpendicular to a recording paper transport direction is increased on a downstream side of the recording paper transport direction by increasing the pressing force.

6. The fixing apparatus according to claim 5, wherein by increasing the pressing force to increase the contact region of the nip area in the direction perpendicular to the recording paper transport direction on the downstream side of the recording paper transport direction, an insertion point of a leading edge portion of the sheet of recording paper to the nip area is kept constant in both modes of the color processing mode and the monochrome processing mode.

* * * * *